US008701678B2

(12) United States Patent
Drabner

(10) Patent No.: US 8,701,678 B2
(45) Date of Patent: Apr. 22, 2014

(54) METHOD FOR THE CONTINUOUS MANUFACTURE OF SMOKING ARTICLES

(75) Inventor: Manfred Drabner, Cormondreche (CH)

(73) Assignee: Philip Morris USA Inc., Richmond, VA (US)

( * ) Notice: Subject to any disclaimer, the term of this patent is extended or adjusted under 35 U.S.C. 154(b) by 1311 days.

(21) Appl. No.: 11/657,033

(22) Filed: Jan. 24, 2007

(65) Prior Publication Data

US 2007/0199570 A1 Aug. 30, 2007

(30) Foreign Application Priority Data

Jan. 24, 2006 (EP) ..... 06250353

(51) Int. Cl.
*A24C 1/00* (2006.01)

(52) U.S. Cl.
USPC ..... 131/33

(58) Field of Classification Search
USPC ..... 131/33
See application file for complete search history.

(56) References Cited

U.S. PATENT DOCUMENTS

| | | | | |
|---|---|---|---|---|
| 3,170,353 | A | 2/1965 | Wheeler et al. | |
| 3,352,308 | A | 11/1967 | Lindgren | |
| 3,744,498 | A | 7/1973 | Imbert | |
| 4,103,692 | A | 8/1978 | Baier et al. | |
| 4,144,896 | A | 3/1979 | Daenen | |
| 4,186,757 | A | 2/1980 | Bornsztein | |
| 4,286,605 | A * | 9/1981 | Goslin et al. | 131/358 |
| 6,742,525 | B2 * | 6/2004 | Sinclair, Jr. | 131/365 |

FOREIGN PATENT DOCUMENTS

| | | |
|---|---|---|
| DE | 3934660 | 4/1991 |
| GB | 19132 | 0/1908 |
| GB | 282364 A | 3/1928 |
| GB | 1189429 B | 3/1965 |

OTHER PUBLICATIONS

International Search Report and Written Opinion dated Jul. 18, 2007 for PCT/IB2007/000678.
International Preliminary Report on Patentability dated Jul. 29, 2008 for PCT/IB2007/000678.

* cited by examiner

*Primary Examiner* — Katarzyna Wyrozebski Lee
*Assistant Examiner* — John Blades
(74) *Attorney, Agent, or Firm* — Buchanan Ingersoll & Rooney PC

(57) ABSTRACT

A method for the continuous manufacture of cigarillos and other smoking articles comprising a rod of smokable material and a wrapper of tobacco leaf material circumscribing the rod comprises: conveying an elongate web of tobacco leaf material along a pre-determined path; repeatedly severing the elongate web to form a succession of discrete wrappers; contacting each of the succession of discrete wrappers with a respective one of a succession of rods of smokable material; and convoluting the discrete wrappers around the rods of smokable material to form smoking articles. The method may further comprise cutting a plurality of polygonal tobacco leaf portions from at least one tobacco leaf; and tessellating the plurality of polygonal tobacco leaf portions to form the elongate web.

11 Claims, 5 Drawing Sheets

METHOD FOR THE CONTINUOUS MANUFACTURE OF SMOKING ARTICLES

CROSS-REFERENCE TO RELATED APPLICATION

Figure 1:
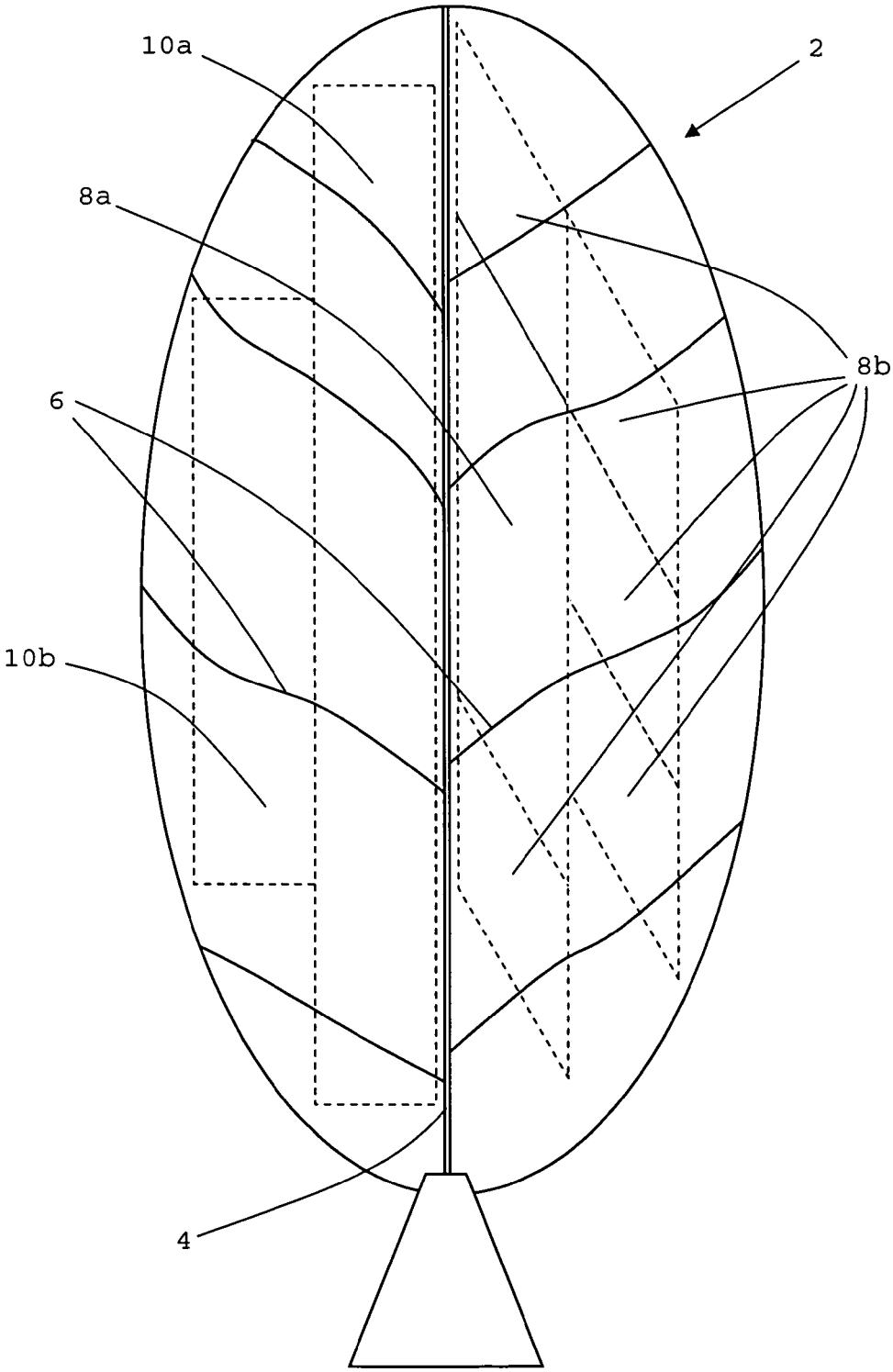

This application claims priority under 35 U.S.C. §119 to European Application No. 06250353.7, filed Jan. 24, 2006, the entire content of which is hereby incorporated by reference.

The present invention is directed to a method for the continuous manufacture of smoking articles comprising a rod of smokable material and a wrapper of tobacco leaf material circumscribing the rod.

Elongate smoking articles, such as cigarettes and cigarillos, comprising a cylindrical rod of tobacco cut filler or threshed tobacco circumscribed in an outer wrapper are well known in the art. The outer wrapper of a cigarillo typically consists of a strip of tobacco cut out from a tobacco leaf, which is wrapped around the cylindrical rod of tobacco cut filler or threshed tobacco to form a tobacco leaf wrapper. The size of the strip of tobacco leaf required to wrap a cigarillo is smaller than the overall area of a tobacco leaf. Consequently, a single tobacco leaf may be cut to yield more than one cigarillo wrapper.

As they are relatively expensive, when using tobacco leaves to make smoking article wrappers it is desirable to utilise the limited area of the leaves effectively, to yield as many wrappers as possible. Tobacco leaves can be very brittle, making them difficult to work with. In addition, several other factors must be taken into consideration when making wrappers for smoking articles from tobacco leaves. Firstly, tobacco leaves have two distinct faces, a front or upper face on which the sun has shone and a rear or lower face. In a cigarillo, the cut strip of tobacco leaf is normally wrapped around the cylindrical rod of tobacco cut filler or threshed tobacco so that the front side of the tobacco leaf is on the outside of the finished cigarillo. Secondly, tobacco leaves also have distinct left and right sides due to the different direction of venation on the left and right sides of the leaf. As a result of the distinct faces and sides of the leaves, strips or other portions cut out from the left side of a tobacco leaf are not the same as those cut out from the right side of the leaf.

Furthermore, the entire area of a tobacco leaf is typically not suitable for use as a smoking article wrapper. Parts of the tobacco leaf that may be unsuitable include, for example, areas with holes, fissures and cracks and areas where the venation of the leaf is too prominent. Methods and devices for selecting suitable parts of tobacco leaves from which to cut out strips or other portions for use in wrappers for smoking articles are known in the art. For example, EP-A-0 032 120 describes a method of selecting the cutting position of a cigar wrapper cutter having a preselected shape with respect to a natural tobacco leaf using a remotely created leaf image.

In the production of cigarillos with tobacco leaf wrappers, an elongate tobacco rod is made from cut tobacco filler or threshed tobacco in a first step. In a second process, the tobacco rod is cut into discrete lengths, which are collected in containers. The cut lengths of tobacco rod are then over rolled with strips of tobacco leaf in a third offline process to produce cigarillos.

The process of over rolling the cut lengths of tobacco rod with the strip of tobacco leaf is performed in a direction perpendicular to the longitudinal axis of the tobacco rod. Usually, the strip of tobacco leaf, supplied at an angle to the tobacco rod's longitudinal axis is wound helically around the cut length of tobacco rod by this perpendicular movement of the tobacco rod, which gives the cigarillo its distinct appearance. Due to the brittle nature of the tobacco leaf material and the offline over rolling process, the production process typically only runs at a speed of about 120 cigarillos per minute.

It would be desirable to increase the comparably slow speed of making cigarillos and other elongate smoking articles having wrappers formed from tobacco leaves. It would also be desirable to utilise the area of tobacco leaves, which as previously discussed are a comparatively expensive ingredient, more effectively when making wrappers for these smoking articles.

According to the present invention there is provided a method for the continuous manufacture of smoking articles comprising a rod of smokable material and a wrapper of tobacco leaf material circumscribing the rod, the method comprising: conveying an elongate web of tobacco leaf material along a pre-determined path; repeatedly severing the elongate web to form a succession of discrete wrappers; contacting each of the succession of discrete wrappers with a respective one of a succession of rods of smokable material; and convoluting the discrete wrappers around the rods of smokable material to form smoking articles.

The method of the present invention advantageously enables known high speed, inline, filter tipping machinery used for the production of filter cigarettes to also be used for the continuous production of cigarillos and other smoking articles having wrappers of tobacco leaf material. The use of known filter tipping machinery, whereby rods of tobacco are joined to axially aligned filter plugs by lengths of tipping paper, allows the rate of cigarillo production to be increased considerably.

Examples of high speed filter tipping machines are the MAX and MAX S tipping machines distributed by Hauni Maschinenbau AG of Hamburg, Germany. In such machines, an elongate web of tipping paper is drawn from a bobbin, pasted on one side with an adhesive and then subdivided into discrete lengths substantially equal to the circumference of the tobacco rods and a desired overlap. The discrete adhesive-coated lengths of tipping paper are attached substantially tangentially to groups of coaxial rod-shaped articles held by vacuum in grooves or flutes on the surface of a rotating drum and the groups transported to a wrapping or rolling station where the groups are rotated about their respective longitudinal axes to convolute the lengths of tipping paper therearound. Typically, the lengths of tipping paper are attached to groups of coaxial rod-shaped articles consisting of a pair of single length wrapped tobacco rods separated by a double length filter rod, so that the convoluted length of tipping paper surrounds the filter rod and the adjacent inner end portions of the wrapped tobacco rods. The resulting double length filter cigarette is severed midway along the convoluted length of tipping paper to yield two filter cigarettes of unit length.

Preferably, the method of the present invention comprises severing the elongate web of tobacco leaf material into discrete lengths substantially equal to the circumference of the rods of smokable material or into discrete lengths substantially equal to the circumference of the rods of smokable material plus a desired overlap.

The method of the invention may further comprise applying an adhesive to the surface of the elongate web.

Preferably, the method comprises bringing each of the succession of discrete wrappers into substantially tangential contact with a respective one of a succession of rods of smokable material.

Preferably, the method comprises convoluting the discrete wrappers around the rods of smokable material so that the longitudinal edges of the wrappers are substantially parallel to the longitudinal axes of the rods of smokable material.

Methods according to the present invention may also be used for the continuous production of smoking articles further comprising a filter. For example, the method may comprise contacting each of the discrete wrappers with a respective one of a succession of rods of smokable material with axially aligned abutting filters; and convoluting the discrete wrappers around the rods of smokable material and filters to the form the smoking articles.

The width of the elongate web may be substantially equal to the length of the rods of smokable material. Where a method according to the present invention is used for the continuous production of smoking articles comprising a filter, the width of the elongate web may be substantially equal to the length of the smoking articles.

Preferably, the method further comprises: cutting a plurality of polygonal tobacco leaf portions from at least one tobacco leaf; and tessellating the plurality of polygonal tobacco leaf portions to form the elongate web.

According to the invention there is also provided an elongate web of tobacco leaf material for wrapping a plurality of smoking articles, the web comprising a plurality of tessellated, polygonal tobacco leaf portions.

The term polygonal tobacco leaf portion is used throughout the specification to describe a treated or untreated area of material cut out from a tobacco leaf, which has at least three straight sides.

The formation of an elongate web of tobacco leaf material from a plurality of tobacco leaf portions, at least some of which may be of comparatively small area, enables small "left over" regions of the tobacco leaf to be utilised and allows regions of the tobacco leaf that are unsuitable for inclusion in a wrapper to be easier accounted for. In addition, it is easier to place and cut out tobacco leaf portions of good tobacco leaf quality having a comparatively small area from a tobacco leaf than it is to place and cut out larger tobacco leaf portions of good tobacco leaf quality. Indeed, the number of smaller tobacco leaf portions may advantageously be increased in such a way, that more of the area of the tobacco leaf can be utilised than with larger tobacco leaf portions.

The formation of elongate webs of tobacco leaf material comprising a patchwork of interlocking tobacco leaf portions, thereby advantageously allows the limited area of tobacco leaves to be utilised more effectively in the formation of wrappers for smoking articles.

The elongate web may comprise a plurality of polygonal tobacco leaf portions of the same or different shape. For example, the web may comprise triangular, quadrilateral and/or hexagonal tobacco leaf portions. Preferably the elongate web comprises a plurality of tessellated, quadrilateral, tobacco leaf portions. More preferably, a plurality of tessellated, quadrilateral, tobacco leaf portions having at least one pair of opposed parallel sides. For example, the quadrilateral tobacco leaf portions may be square, rectangular, rhomboid and/or trapezoidal in shape. Throughout the specification, trapezoidal is used to describe a quadrilateral having a single pair of opposed parallel sides. Preferably, the opposed parallel sides of the plurality of tessellated, quadrilateral, tobacco leaf portions form opposed, parallel, longitudinal edges of the elongate web. More preferably, opposed, parallel, substantially straight, longitudinal edges of the elongate web.

Preferably, the elongate web comprises a plurality of tessellated, non-right angle parallelogram, tobacco leaf portions or a plurality of tessellated, trapezoidal, tobacco leaf portions. The elongate web may comprise a plurality of tessellated, isosceles trapezoidal, tobacco leaf portions, that is a plurality of tessellated, trapezoidal, tobacco leaf portions having a first pair of opposed, parallel sides and a second pair of opposed, non-parallel sides of equal length.

Preferably, the elongate web comprises a plurality of tessellated, polygonal tobacco leaf portions of substantially the same shape.

The elongate web may comprise a plurality of polygonal tobacco leaf portions of the same or different size.

Preferably, elongate webs of tobacco leaf material according to the present invention comprise tobacco leaf portions having substantially the same width in the transverse or direction of the web. Preferably the width of the tobacco leaf portions is greater than or equal to the width of a wrapper for a smoking article to be formed from the elongate web.

Preferably, the elongate web has a width substantially corresponding to an integer multiple of the circumference or length of a smoking article to be wrapped in a wrapper formed there. In a particularly preferred embodiment, the elongate web has a width substantially equal to the circumference or length of a smoking article to be wrapped in a wrapper formed there from. Alternatively, the initial elongate web may be separated into multiple elongate webs each having a width substantially equal to the circumference or length of a smoking article to be wrapped.

Elongate webs of tobacco leaf material according to the invention may comprise a plurality of tessellated, congruent, polygonal tobacco leaf portions, that is a plurality of tessellated, polygonal tobacco leaf portions of substantially the same shape and size.

In a preferred embodiment, the elongate web comprises a tessellated line or column of individual, polygonal tobacco leaf portions. More preferably, a tessellated line or column of individual, polygonal tobacco leaf portions of substantially the same width. Preferably the width of the individual, polygonal tobacco leaf portions is substantially equal to the circumference of a smoking article to be wrapped in a wrapper formed from the elongate web. Preferably, the individual, polygonal tobacco leaf portions are quadrilateral, with a pair of opposed parallel sides that form common, opposed, parallel, longitudinal edges of the elongate web.

If desired, elongate webs of tobacco leaf material according to the invention may, however, comprise two or more tessellated, polygonal tobacco leaf portions across the transverse direction thereof.

The plurality of polygonal tobacco leaf portions may be tessellated so that adjacent edges of neighbouring tobacco leaf portions within the elongate web abut one another. Alternatively, the plurality of polygonal tobacco leaf portions may be tessellated so that there is a small overlap between adjacent edges of neighbouring tobacco leaf portions within the elongate web. Preferably, adjacent edges of neighbouring tobacco leaf portions in the longitudinal direction of the elongate web overlap to form a visible ridge, which runs laterally across the elongate web.

The plurality of tessellated, polygonal tobacco leaf portions may be glued or otherwise affixed to one another by any suitable means known in the art.

In one embodiment of the invention, the elongate web comprises a plurality of tessellated, tobacco leaf portions, each in the form of a parallelogram, wherein the first parallelogram edge is opposed and parallel to the second parallelogram edge and wherein the third parallelogram edge is opposed and parallel to the fourth parallelogram edge. Each tobacco leaf portion is attached along the third parallelogram edge thereof to the fourth parallelogram edge of the next tobacco leaf wrapper portion to form the elongate web so that the first parallelogram edges of the plurality of tessellated, tobacco leaf portions form a substantially common first longitudinal web edge and the second parallelogram edges of the plurality of tessellated, tobacco leaf portions form a substantially common second longitudinal web edge. The plurality of tobacco leaf portions do not all have to have the same length, between the third parallelogram edges and fourth parallelogram edges thereof, but do have a substantially common width, between the first parallelogram edges and second parallelogram edges thereof, in order that substantially common longitudinal web edges may be achieved. Preferably, the parallelogram tobacco leaf portions have a non-right angle, non-rectangular form.

As previously described, the third parallelogram edges and fourth parallelogram edges of the neighbouring, parallelogram, tobacco leaf portions preferably overlap each in such a way that a visible ridge is formed along this overlap, where the tobacco leaf material is double.

As the parallelogram, tobacco leaf portions are preferably not right angled, this ridge has a helical shape when the elongate web of tobacco leaf material is wrapped around a rod of smokable material to form a smoking article, as described in more detail below. The helical ridge looks similar to the helical seam formed when a strip of tobacco leaf is over rolled around a tobacco rod to produce a cigarillo in a conventional manner.

In a particularly preferred embodiment, the elongate web of the present invention comprises a plurality of tessellated, non-right angle parallelogram, tobacco leaf portions of substantially the same shape and size, wherein the sum of the square of the length of the first parallelogram edge and the square of the width of each tobacco leaf portion is essentially equal to the square of the length of the third parallelogram edge thereof. This particular geometry of the tobacco leaf portions has two effects.

Firstly, when looking onto the tobacco leaf wrapper web from above, the end of the first parallelogram edge of each tobacco leaf portion along the first longitudinal web edge and the beginning of the second parallelogram edge of each tobacco leaf portion along the opposed, parallel, second longitudinal web edge are essentially opposite one another, i.e. the virtual transverse line connecting the end of the first parallelogram edge to the beginning of the second parallelogram edge is perpendicular to the longitudinal edges of the elongate web.

Secondly, when looking at the elongate web once it has been wrapped around a rod of smokable material so that the first longitudinal web edge and second longitudinal web edge abut to form a seam parallel to the longitudinal axis of the rod of smokable material, the end of the first parallelogram edge and the beginning of the second parallelogram edge share the same location along the seam. In practice, this means that the visible ridge created by the overlap of the third parallelogram edge of a first tobacco leaf portion and the fourth parallelogram edge of a second, adjacent, tobacco leaf portion abuts the visible ridge created by the overlap of the third parallelogram edge of the second tobacco leaf portion and the fourth parallelogram edge of a third, adjacent, tobacco leaf portion, distant from the first tobacco leaf portion, along the seam. The separate ridges between the tobacco leaf portions within the elongate web thereby have the same appearance as if they were a single helical ridge running spirally around the entire smoking article, giving the smoking article the same appearance as cigarillos manufactured by over rolling rods of tobacco with strips of tobacco leaf on a conventional cigarillo manufacturing machine.

In an alternative embodiment the angles and length of the edges of the parallelogram, tobacco leaf portions are such that two ridges that surround the cigarillo in a double helix are formed by overlap between adjacent edges of neighbouring tobacco leaf portions in the elongate web. Similarly, a triple helix and so on may also be produced.

The elongate web of tobacco leaf material may comprise polygonal tobacco leaf portions of any suitable size. Preferably, however, at least a majority of the plurality of tessellated, polygonal tobacco leaf portions are relatively large, since large tobacco leaf portions have a greater inner "natural" strength than smaller tobacco leaf portions. The inclusion of relatively large tobacco leaf portions also advantageously reduces the number of steps required to assemble the elongate web of tobacco leaf material.

By altering the size, shape and/or number of polygonal, tessellated tobacco leaf portions, elongate webs of tobacco leaf material of different length and width may be produced. For example, elongate webs having a length of several hundreds of metres, which may be wound up on bobbins in a conventional manner, may be produced.

Preferably, when wound up on bobbins, elongate webs according to the invention have a diameter substantially corresponding to that of commonly used tipping paper or cigarette paper bobbins. The formation of bobbins of elongate webs of tobacco leaf material according to the invention having diameters substantially equal to that of cigarette paper bobbins, advantageously enables known high speed, inline, processes and machinery used for the production of cigarettes to also be used in the production of cigarillos and other smoking articles having wrappers of tobacco leaf material. The use of known cigarette manufacturing processes and machinery, whereby an elongate web of cigarette paper is wrapped around a rod of tobacco as the rod of tobacco is transported longitudinally downstream, allows the rate of cigarillo production to be increased considerably. For example, the rate of production may be increased to more than 500 cigarillos per minute as compared to the rate of about 120 cigarillos per minute achieved when over rolling cigarillos with strips of tobacco leaf in a conventional manner.

The elongate web of tobacco leaf material may further comprise a support layer to which the plurality of tessellated, polygonal tobacco leaf portions is affixed. The support layer may be made from any suitable substrate known in the art including, but not limited to, reconstituted tobacco and cigarette paper. Preferably, the support layer is made of reconstituted tobacco. More preferably, from reconstituted tobacco that is more flexible and thinner than the polygonal tobacco leaf portions.

The plurality of tessellated, polygonal tobacco leaf portions may be affixed to the support layer of the elongate web such that they are contiguous, but do not overlap, with adjacent edges of neighbouring polygonal tobacco leaf portions within the elongate web abutting one another. The support layer may be a single strip of reconstituted tobacco or other substrate or may comprise a number of smaller, preferably parallel, strips, for example two parallel strips. Preferably the support layer has a pair of opposed longitudinal edges that are substantially parallel and adjacent to the opposed longitudinal edges of the elongate web.

Where elongate webs of tobacco leaf material according to the invention comprise a support layer, preferably one of the pair of longitudinal edges of the support layer is outwardly offset relative to the adjacent longitudinal edge of the web. More preferably, the other longitudinal edge of the support layer is also inwardly offset relative to the adjacent edge of the web.

In use, when the elongate web according to the invention is wrapped around a rod of smokable material, so that the longitudinal edges of the web abut one another and are parallel to the longitudinal axis of the rod, the portion of the support layer between the outwardly offset, longitudinal edge thereof and the adjacent longitudinal edge of the web is advantageously overlapped by, and may be affixed to, the portion of the web between the other, outwardly offset, longitudinal edge of the support layer and the adjacent longitudinal edge of the web. To ensure an equal wrapper thickness around the smoking article, the first longitudinal edge of the support layer and the second longitudinal edge of the support layer of the elongate web according to the invention are preferably inwardly offset and outwardly offset by the same amount relative to the longitudinal edges of the elongate web. Where the support layer comprises two or more strips of reconstituted tobacco or other substrate, the pair of longitudinal edges of the support layer that are preferably offset relative to the longitudinal edges of the elongate web of the invention are those closest to the longitudinal edges of the elongate web.

The individual, polygonal tobacco leaf portions forming the elongate web of tobacco leaf material advantageously have dimensions that are independent from the actual size of a cigarillo or other smoking article to be wrapped. Each individual tobacco leaf portion making up the elongate web may cover only part of a smoking article, an entire smoking article or even several smoking articles that are circumscribed in wrappers formed from the web.

Where elongate webs according to the invention are used to manufacture cigarillos or other smoking articles using a process like that used to produce cigarettes, that is a process in which the elongate web is wrapped around a rod of smokable material with the longitudinal edges thereof parallel to the longitudinal axis of the rod, it is preferable that the width of the individual tobacco leaf portions substantially corresponds to the circumference of the rod of smokable material. Where elongate webs according to the invention are wound helically around rods of smokable material to form cigarillos or other smoking articles, the width of the elongate web, and so width of the individual tobacco leaf portions, may be entirely independent of the size of the smoking article, provided that the pitch of the helix is adjusted accordingly.

The invention further provides a wrapper for a smoking article formed from an elongate web of tobacco leaf material according to the invention and an elongate smoking article comprising a rod of smokable material circumscribed by such a wrapper.

Preferably, the width of the wrapper substantially corresponds to the circumference of the smoking article to be wrapped therein. It is particularly preferred if the width of the wrapper is about 27 mm, which corresponds to the typical circumference of a cigarette. In use, when the wrapper is wrapped around a rod of smokable material to form a smoking article, with the longitudinal edges thereof parallel to the longitudinal axis of the rod as previously described, the longitudinal edges of the wrapper thereby abut one another to form a virtually invisible, longitudinal seam that runs along the length of the formed smoking article.

Preferably, the smoking article is a cigarillo. Preferably, the wrapper is wrapped around the rod of smokable material so that the longitudinal edges of the wrapper are parallel to the longitudinal axis of the rod of smokable material. Alternatively, the wrapper may be spiralled helically around the rod of smokable material.

The smoking article may further comprise a filter, in axial alignment with the rod of smokable material at one end thereof. Cigarillos with filters are known in the art and the filter may be any filter suitable for use in cigarillos or cigarettes. The filter may be attached to the rod of smokable material by tipping material in a conventional manner. So that the filter is not visible in the formed smoking article, the tipping material may be formed from an elongate web of tobacco leaf material according to the invention. Alternatively or in addition, the filter may be attached to the rod of smokable material and the rod and filter then circumscribed by the wrapper of the invention.

According to the invention there is also provided a method of manufacturing a smoking article comprising a rod of smokable material and a wrapper circumscribing the rod, the method comprising: cutting a plurality of polygonal tobacco leaf portions from at least one tobacco leaf; tessellating the plurality of polygonal tobacco leaf portions to form an elongate web; and wrapping the web around a rod of smokable material.

Preferably, the method comprises forming a continuous rod of smokable material, wrapping the web around the rod and then severing the wrapped rod into discrete lengths. Preferably, the web is wrapped around the rod of smokable material as the rod is transported longitudinally downstream with the longitudinal edges of the web parallel to the longitudinal axis of the rod.

In an alternative embodiment, the web may be supplied at an angle to the longitudinal axis of the rod of smokable material and wound helically around the rod.

In a yet further embodiment, a plurality of individual wrappers may be cut or stamped out from the elongate web and then each wrapper over rolled around a discrete rod of smokable material in a conventional manner to form a smoking article.

Preferably, the method further comprises attaching a filter to the rod of smokable material. Methods for attaching filter elements to tobacco rods prior to wrapping are well known in the art of filter cigarette making. The present invention enables such manufacturing processes to also be employed in the manufacture of filter cigarillos and other filter smoking articles having wrappers formed from tobacco leaf material. For example, as in filter cigarette making, the method of attaching the filter to the rod of smokable material may include the use of a double filter, which is attached to a rod of smokable material on either side and then cut into half to form two complete filter cigarillos or other smoking articles according to the invention as previously described.

Figure 2A:
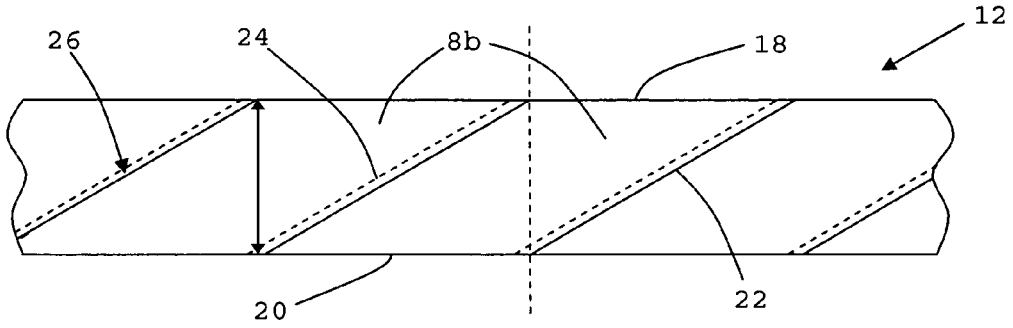
Figure 2B:
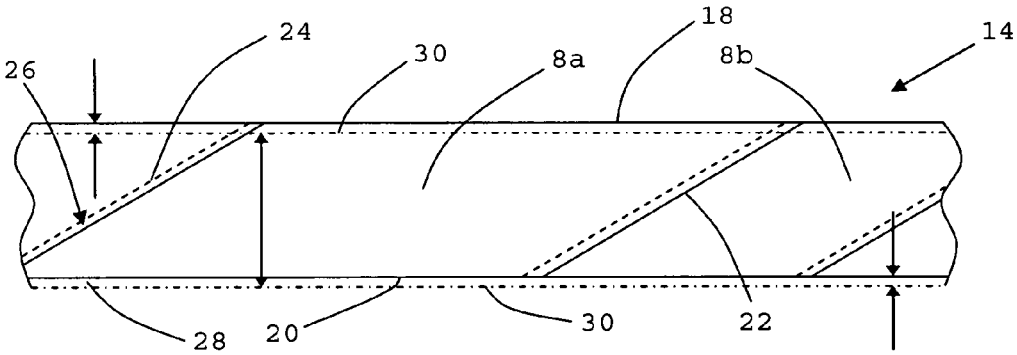
Figure 2C:
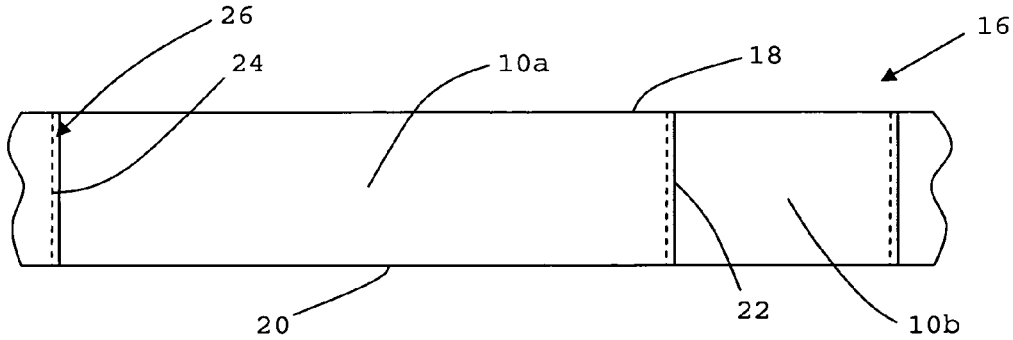
Figure 3:
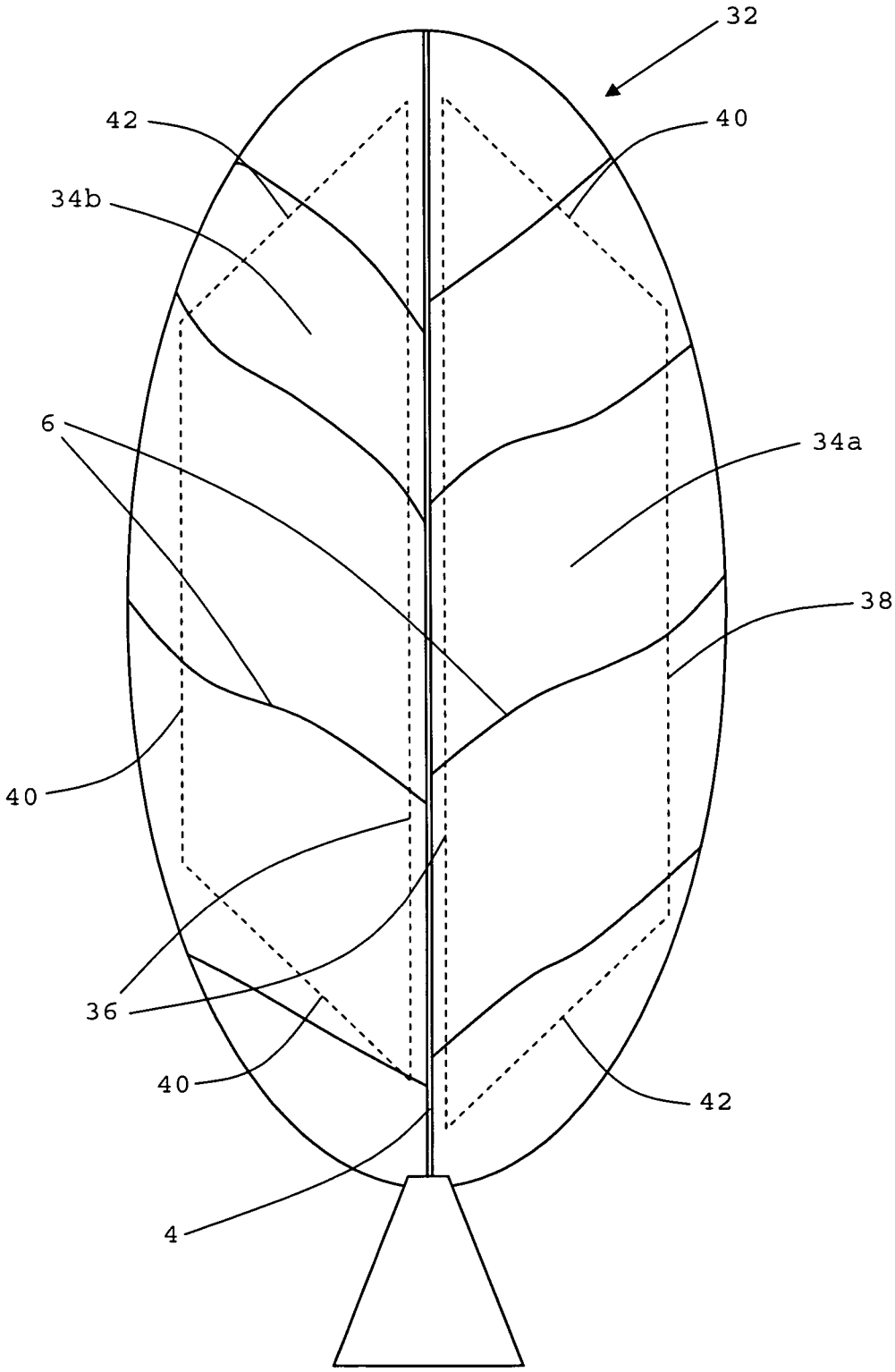
Figure 4A:
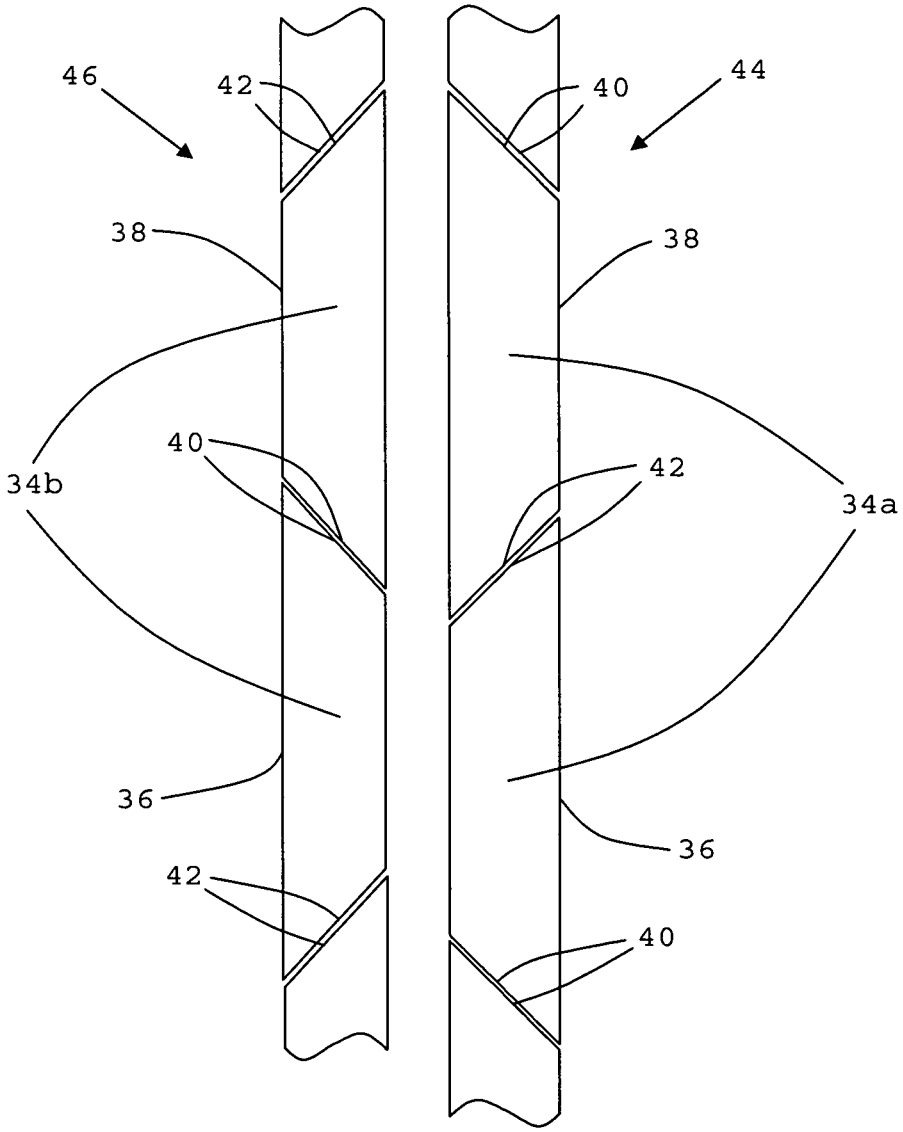
Figure 4B:
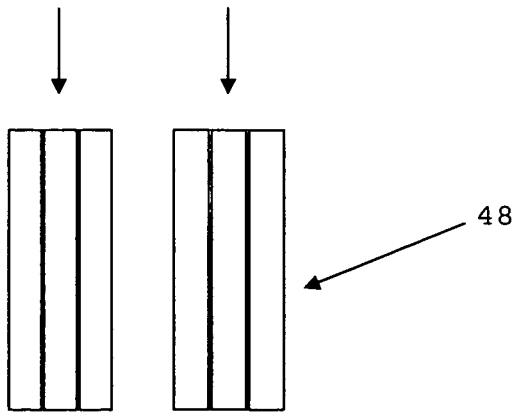

The invention will now be further described, by way of example only, with reference to the accompanying drawings, in which:

FIG. 1 shows a schematic plan view of the upper face of a first tobacco leaf from which a plurality of quadrilateral tobacco leaf portions are to be cut;

FIG. 2*a* shows a top view of a section of a web of wrapping material according to a first embodiment of the invention;

FIG. 2*b* shows a plan view of a section of a web of wrapping material according to a second embodiment of the invention;

FIG. 2*c* shows a plan view of a section of a web of wrapping material according to a third embodiment of the invention;

FIG. 3 shows a schematic plan view of the upper face of a second tobacco leaf from which a pair of trapezoidal tobacco leaf portions are to be cut;

FIG. 4*a* shows a plan view of sections of two webs of wrapping material according to a fourth embodiment of the invention, comprising a plurality of tessellated, trapezoidal tobacco leaf elements; and FIG. 4*b* shows a plan view of smoking article wrappers formed from the webs of FIG. 5*a*.

Figure 5:
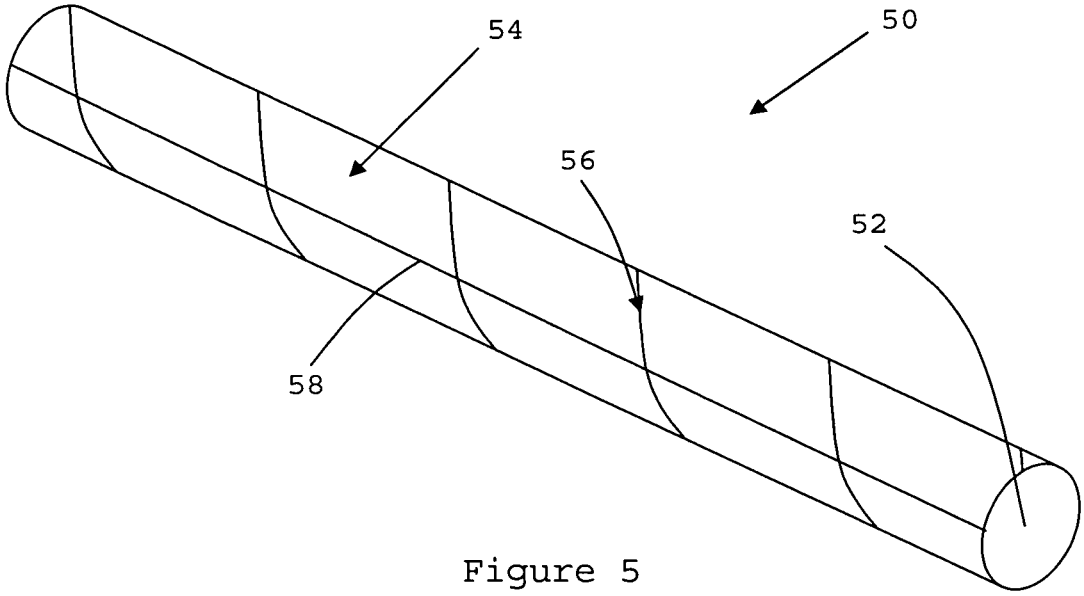

FIG. 5 shows a perspective view of a cigarillo according to the invention.

The tobacco leaves, webs of wrapping material and cigarillo shown in the drawings have several components in common; these have been given the same reference numerals throughout.

FIG. 1 shows the upper face of a typical tobacco leaf 2 having a midrib or stem 4 and venation 6. As previously described, the upper face of the tobacco leaf 2, on which the sun has shone, has a different structure to the lower face thereof (not shown). In addition, due to the direction of venation 6, the left side of the tobacco leaf 2 differs from the right side thereof as shown in FIG. 1. A plurality of quadrilateral tobacco leaf portions 8*a*, 8*b*, 10*a*, 10*b* (shown by dashed lines in FIG. 1) for use in the formation of an elongate web of tobacco leaf material may be cut out from the tobacco leaf 2 on either side of the stem 4.

Sections of three different embodiments of elongate webs 12, 14, 16 of tobacco leaf material according to the invention are shown in FIGS. 2*a*, 2*b* and 2*c*, respectively, each comprising a plurality of tessellated, quadrilateral tobacco leaf portions 8*a*, 8*b*, 10*a*, 10*b* of the type shown in FIG. 1. In each embodiment, the tobacco leaf portions 8*a*, 8*b*, 10*a*, 10*b* forming the webs are parallelograms with two pairs of opposed parallel edges: a first parallelogram edge 18, which is parallel and opposed to a second parallelogram edge 20 and a third parallelogram edge 22, which is parallel and opposed to a fourth parallelogram edge 24. Within each web 12, 14, 16, the width $W_w$ of the parallelogram, tobacco leaf portions 8*a*, 8*b*, 10*a*, 10*b*, between the first parallelogram edge 18 and second parallelogram edge 20 thereof, is the same.

To form the webs 12, 14, 16 shown in FIGS. 2*a*, 2*b* and 2*c*, respectively, the parallelogram tobacco leaf portions 8*a*, 8*b*, 10*a*, 10*b* are tessellated with the third parallelogram edge 22 of one portion adjacent to the fourth parallelogram edge 24 of the next portion, so that the first parallelogram edges 18 of the plurality of tessellated tobacco leaf portions form a common first web edge and the second parallelogram edges 20 form an opposed, parallel, common second web edge. The width of the webs 12, 14, 16, between the first web edge and second web edges thereof, thereby corresponds to the width $W_w$ between the first parallelogram edges 18 and second parallelogram edges 20 of the tobacco leaf portions and is preferably substantially same as the circumference of a cigarillo. The length of the individual tobacco leaf portions 8*a*, 8*b*, 10*a*, 10*b* may exceed the length of a cigarillo or other smoking article to be wrapped and is limited only by the size of the tobacco leaf 2.

In the web 12 of tobacco leaf material according to the first embodiment of the invention shown in FIG. 2*a*, the plurality of tessellated, tobacco leaf portions 8*b* are all non-right angle parallelograms of substantially the same size and shape. To join the tobacco leaf portions 8*b* together, there is a small overlap between the third parallelogram edge 22 and fourth parallelogram edge 24 of adjacent tessellated tobacco leaf portions 8*b* in the web 12, which gives rise to a ridge 26 of double thickness in the web 12. The dimensions and internal angles of the non-right angle parallelogram, tobacco leaf portions 8*b* are such that the end of the ridge 26 between an adjacent pair of tobacco leaf portions 8*b* on the common first web edge is opposite the end of the ridge 26 between the following adjacent pair of tobacco leaf portions 8*b* on the common second web edge (as shown by the dashed line in FIG. 2*a*). Consequently, when the common first web edge and common second web edge are brought into abutment by wrapping the web 12 longitudinally around a rod of smokable material, the ends of the ridges 26 between the tessellating tobacco leaf portions 8*b* line up with one another to produce a continuous helical line that spirals around the formed smoking article, as shown in FIG. 5.

The web 14 of tobacco leaf material according to the second embodiment of the invention shown in FIG. 2*b* is of similar overall construction to the web 12 shown in FIG. 2*a*. However, while the plurality of tessellated tobacco leaf portions 8*a*, 8*b* making up the web 14 are all non-right angle parallelograms having the same width and internal angles, they are of differing lengths. In addition, as well as being joined together by the small overlap between the third parallelogram edges 22 and fourth parallelogram edges 24 thereof, the tessellated tobacco leaf portions 8*a*, 8*b* in the web 14 are affixed to a support layer 28 of reconstituted tobacco. The support layer 28 has a width $W_s$ corresponding to that of the web 14, but is laterally offset relative to the plurality of tessellated tobacco leaf portions 8*a*, 8*b*, in the transverse direction of the web 14, so that the edges 30 of the support layer 28 (shown by the broken and dotted lines in FIG. 2*b*) are offset relative to the common first web edge and common second web edge formed by the first parallelogram edges 18 and second parallelogram edges 20 of the tessellated tobacco leaf portions 8*a*, 8*b*.

To form a wrapper for a smoking article, the common first web edge and common second web edge are brought into abutment by wrapping the web 14 longitudinally around a rod of smokable material. In the formed wrapper, the portion of the web 14 adjacent the common first web edge that extends beyond the support layer 28 (illustrated by the pair of arrows labelled A in FIG. 2*b*) overlaps and is affixed to the portion of the support layer 28 that extends beyond the common second edge of the web 14 (illustrated by the pair of arrows labelled B in FIG. 2*b*).

In alternative embodiments of the invention, the web may comprise two or more parallel support layer strips of reduced width compared to the web itself. Where, the web includes a support layer, the plurality of tessellated tobacco leaf portions may be affixed to the support layer so that the adjacent edges of neighbouring tobacco leaf portions within the elongate web abut one another, without overlapping.

FIG. 2*c* shows a section of a web 16 according to a third embodiment of the invention comprising a plurality of tessellated, rectangular tobacco leaf portions 10*a*, 10*b* of the same width, but differing length. The ridges 26 formed by the small overlap between the third parallelogram edges 22 and fourth parallelogram edges 24 of adjacent tobacco leaf portions 10*a*, 10*b* run transversely across the web 16, perpendicular to the parallel common first and second web edges. To form a wrapper for a smoking article, the tobacco leaf wrapper web 10*c* is preferably wound helically around a rod of tobacco or other smokable material.

FIG. 3 shows the upper face of a second typical tobacco leaf 32 having a midrib or stem 4 and venation 6. A pair of tobacco leaf portions 34*a*, 34*b* (shown by dashed lines in FIG. 3) may be cut out from the tobacco leaf 32 on either side of the stem 4. Each tobacco leaf portion 34*a*, 34*b* is an isosceles trapezoid having two pairs of opposed edges: a first edge 36, which is parallel and opposed to a shorter second edge 38 and a third edge 40, which is opposed to a non-parallel fourth edge 24 of equal length.

FIG. 4*a* shows sections of two webs 44, 46 comprising a plurality of tessellated, isosceles trapezoidal tobacco leaf portions 34*a*, 34*b*. The web 44 shown on the right hand side of FIG. 4*a* comprises a plurality of tessellated, isosceles trapezoidal, tobacco leaf portions 34*a* of the same shape and size, which have been cut out from the right side of a plurality of tobacco leaves as shown in FIG. 3. The web 46 shown on the left hand side of FIG. 4*a* comprises a plurality of tessellated, isosceles trapezoidal, tobacco leaf portions 34*b* of the same shape and size, which have been cut out from the left side of a plurality of tobacco leaves as shown in FIG. 3. Successive tobacco leaf portions 34*a*, 34*b* within each web 44, 46 are rotated through 180 degrees relative to one another in the plane of FIG. 4*a*, so that each tobacco leaf portion 34*a*, 34*b* is tessellated with its third edge 40 and fourth edge 42 adjacent to the third edge 40 and fourth edge 42, respectively, of the tobacco leaf portions 34*a*, 34*b* on either side thereof. As a result of the rotation of successive tobacco leaf portions 34*a*, 34*b* therein, the common first web edges and opposed, parallel, common second web edges of the two webs 44, 46 are formed by alternating first edges 36 and second edges 38 of the tessellated tobacco leaf portions.

Depending upon the number of polygonal tobacco leaf portions tessellated across the width thereof, and the dimensions of the tobacco leaves from which the tobacco leaf portions are cut, the width of webs of tobacco leaf material according to the invention may be greater than the circumference or length of the cigarillo or other smoking article to be wrapped therein. In this case, the web may be cut longitudinally to produce two or more web strips having a width or length substantially equal to the circumference of the smoking article. For example, FIG. 4*b* shows six web strips 48 formed by cutting each of the webs 44, 46 shown in FIG. 4*a* longitudinally into three sections of equal width.

FIG. 5 shows a cigarillo 50 comprising a rod 52 of tobacco cut filler or threshed tobacco, circumscribed by a wrapper 54 formed from a section of the web 12 according to the first embodiment of the invention shown in FIG. 2*a*. The cigarillo is formed by closing the wrapper 54 longitudinally around the rod 50, until the common first web edge and common second web edge of the web 12 are brought into abutment. Since the circumference of the cigarillo 50 is substantially equal to the width $W_w$ of the web 12, the ridges 26 between the tessellating tobacco leaf portions 8*b* form a continuous helical line 56 that spirals around the wrapper 54 as previously described. A small overlap between the common first web edge and common second web edge, along which the wrapper 54 is affixed together, produces a longitudinal seam 58 that runs along the length of the wrapper 54.

Alternatively, using the method of the invention, cigarillos of substantially the same construction as the cigarillo 50 shown in FIG. 5 may be advantageously formed on conventional filter tipping machinery, as previously described above.

If desired, the cigarillo may further comprise a filter, in axial alignment with the rod at one end thereof. The filter may also be circumscribed by the wrapper or may be attached to the wrapped rod by separate tipping material, in which case the separate tipping material is preferably also formed from a web of tobacco leaf material according to the invention.

In the embodiments described above, the width of the webs are equal to the width of a single tobacco leaf portion. It will be appreciated, however, that elongate webs of tobacco leaf material having a width equal to two or more tessellated, polygonal tobacco leaf portions may be similarly formed.

It will also be appreciated that, while in the embodiments described each web comprises a plurality of tessellated, polygonal tobacco leaf portions having substantially the same shape, elongate webs of tobacco leaf material comprising a plurality of tessellated, polygonal tobacco leaf portions having two of more different shapes may be similarly. For example, one or more of the isosceles trapezoidal, tobacco leaf portions 34*a*, 34*b* of the webs 44, 46 shown in FIG. 4*a* could be replaced by a combination of a rectangular, tobacco leaf portion and two, right angle triangular, tobacco leaf portions.

The invention claimed is:

1. A method for the continuous manufacture of smoking articles comprising: a rod of smokable material, a filter, and a wrapper of tobacco leaf material circumscribing the rod and filter, the method comprising:

cutting a plurality of tobacco leaf portions and tessellating the cut leaf portions to overlap each other and form an elongate web of tobacco leaf material;

conveying the elongate web of tobacco leaf material along a pre-determined path;

repeatedly severing the elongate web to form a succession of discrete wrappers;

contacting each of the discrete wrappers with a respective one of a succession of rods of smokable material and axially aligned abutting filters; and convoluting the discrete wrappers around the rods of smokable material and filters to the form the smoking articles so that longitudinal edges of the wrappers are substantially parallel to a longitudinal axes of the rods of smokable material and axially aligned abutting filters.

2. A method according to claim 1 further comprising:

cutting a plurality of polygonal tobacco leaf portions from at least one tobacco leaf; and tessellating the plurality of polygonal tobacco leaf portions to form the elongate web.

3. A method according to claim 2 wherein each of the plurality of polygonal tobacco leaf portions is of substantially the same shape.

4. A method according to claim 3 wherein each of the plurality of polygonal tobacco leaf portions is of substantially the same size.

5. A method according to claim 2 comprising:

cutting a plurality of quadrilateral tobacco leaf portions from at least one tobacco leaf; and tessellating the plurality of quadrilateral tobacco leaf portions to form the elongate web.

6. A method according to claim 5 comprising:

cutting a plurality of non-right angle parallelogram, tobacco leaf portions from at least one tobacco leaf; and tessellating the plurality of non-right angle parallelogram tobacco leaf portions to form the elongate web.

7. A method according to claim 5 comprising:

cutting a plurality of trapezoidal, tobacco leaf portions from at least one tobacco leaf; and tessellating the plurality of trapezoidal, tobacco leaf portions to form the elongate web.

8. A method according to claim 2, wherein the elongate web comprises a support layer, the method further comprising:

affixing the plurality of polygonal, tobacco leaf portions to the support layer.

9. A method according to claim 8, wherein the support layer comprises reconstituted tobacco.

10. A method according to claim 1 wherein the smoking article includes at least two visible helical ridges formed by the overlapping leaf portions.

11. A method according to claim 2 wherein polygonal tobacco leaf portions have a first pair of parallel edges and a second pair of parallel edges.

* * * * *